United States Patent [19]

Monette

[11] 4,419,550

[45] Dec. 6, 1983

[54] ROTARY SWITCH APPARATUS HAVING A MULTIPLE ARM CONTACT SPRING SUPPORT

[75] Inventor: Gerald J. Monette, Wausau, Wis.

[73] Assignee: Marathon Electric Manufacturing Corp., Wausau, Wis.

[21] Appl. No.: 270,596

[22] Filed: Jun. 4, 1981

[51] Int. Cl.[3] ..... H01H 35/10

[52] U.S. Cl. ..... 200/80 R; 200/67 DA; 318/793

[58] Field of Search ..... 200/80 R, 67 DA, 246, 200/7.75, 283, 288, 305; 318/325, 462, 793; 310/68 E; 73/535, 536, 538

[56] References Cited

U.S. PATENT DOCUMENTS

| | | | |
|---|---|---|---|
| 3,178,529 | 4/1965 | McCarrick | 200/67 DA |
| 3,433,908 | 3/1969 | Cunningham | 200/67 DA |
| 3,691,415 | 9/1972 | Hancock | 200/80 R |
| 4,240,001 | 12/1980 | Hildebrandt | 200/80 R |

*Primary Examiner*—G. P. Tolin

*Attorney, Agent, or Firm*—Andrus, Sceales, Starke & Sawall

[57] ABSTRACT

A centrifugal motor switch includes a base plate having a U-shaped fixed contact bracket and a leaf spring contact unit mounted to one side. The plate is mounted adjacent the field winding. The leaf spring is a flat rectangular spring plate including side deflection arms extending from a mounting strip and coupling arms connected to the deflection arms and to a central contact arm which extends outwardly. A wear pad is secured to the deflection arms and abutts the base plate to deflect the spring plate and locate the contacts. The contacts are secured to the fixed support and contact arm. A tab projects from the contact arm to the pad to minimize contact vibration. The bracket is formed of magnetically conductive metal and has side walls partially enclose the contact. A centrifugal operator on the shaft engages the pad and causes axial movement of the pad and spring plate with a rocking motion to rock the contacts.

13 Claims, 6 Drawing Figures

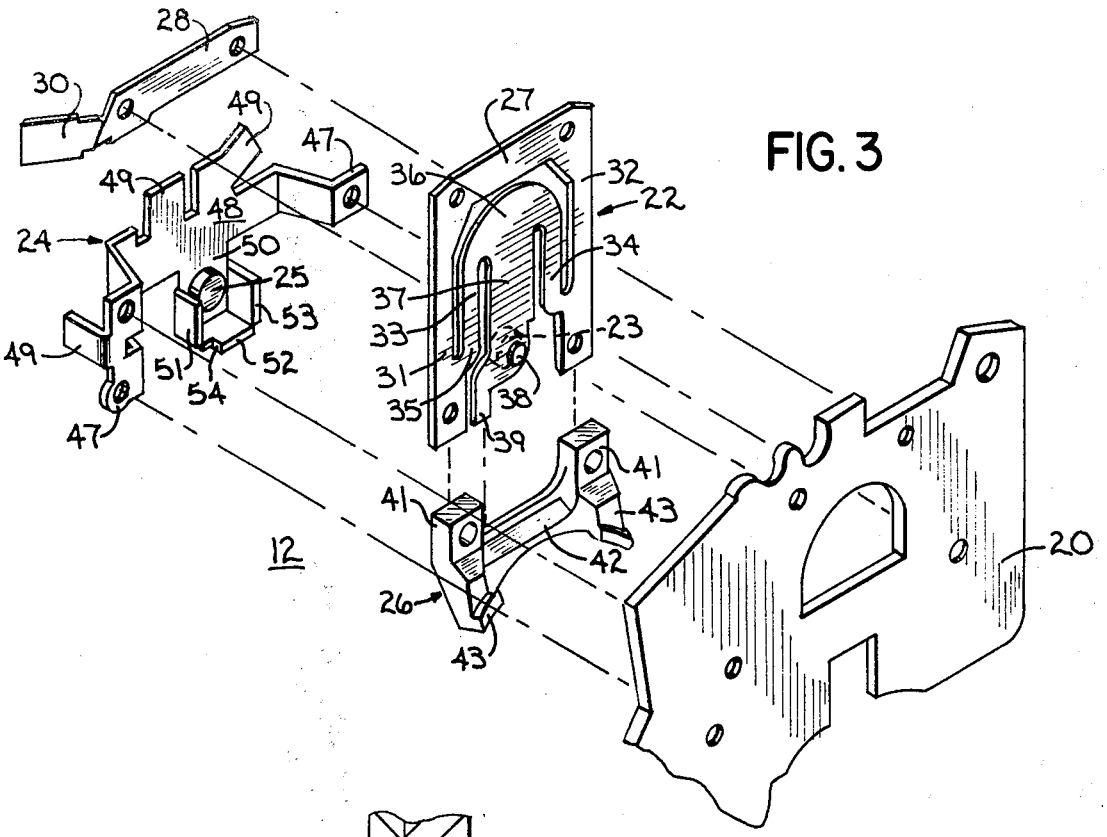
FIG. 3
FIG. 4
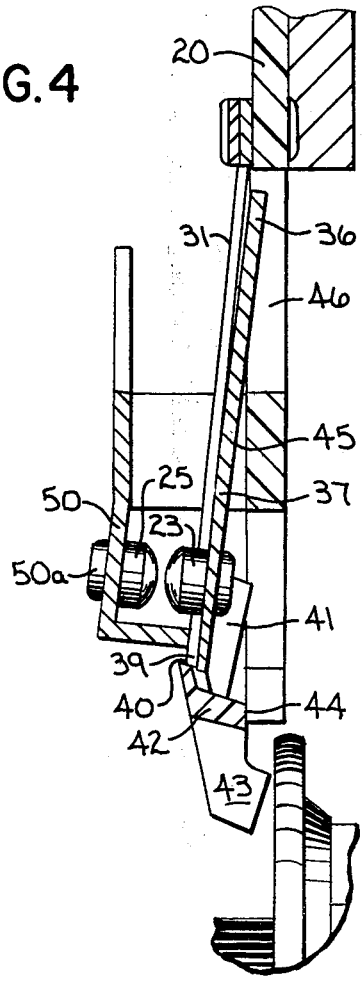
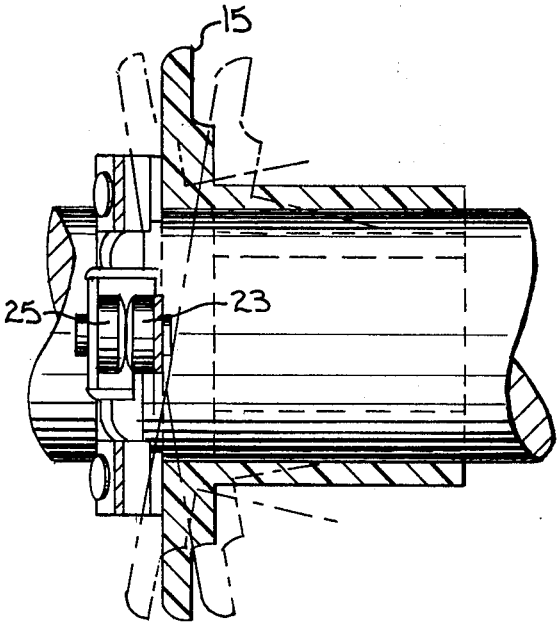
FIG. 5

ROTARY SWITCH APPARATUS HAVING A MULTIPLE ARM CONTACT SPRING SUPPORT

BACKGROUND OF THE INVENTION

This invention relates to a switch assembly for rotating equipment having a centrifugal operator for moving the switch assembly between open and closed positions, and particularly to a start switch for induction motors.

Rotary apparatus used in industrial arts and other fields often includes speed responsive switches for operating or controlling other devices. An alternately current induction motor is a typical and well known application involving a centrifugally actuated switch assembly. An induction motor including a plurality of windings including a running winding and a phase displaced start winding. The start winding is connected in the circuit during the initial starting of the motor to produce increased starting torque for accelerating the motor from standstill to operating speed. As the motor reaches or approaches operating speed, the starting winding is disconnected from the circuit. A widely used switching system includes a switch assembly mounted within the motor and a centrifugal operator or actuator connected to the rotor shaft and having a spring-loaded element. The spring-loaded element is constructed and arranged to move with a snap-action at a selected speed to actuate the switch assembly for disconnecting the start winding from the circuit.

The switch assembly may be constructed with a fixed contact mounted within the motor and a movable contact mounted on a leaf-spring member. The centrifugal operator is mounted to engage and move the spring member.

A particularly satisfactory structure has the centrifugal actuator located to hold the switch closed against the resilient spring force and movable therefrom to allow the switch unit to open under its spring force. Thus, in a practical installation, the switch unit is held closed by the actuator until such time as the operating or switching speed is established. At that instant the centrifugal actuator responds and moves from the switch assembly with an effective snap action. This releases the spring which then moves to the opened position under or as the result of the spring tension in the spring.

The snap-action movement of the actuator and the switch leaf-spring is important to establish a change between a full-on and a full-off circuit connection. Thus, during the starting period, the switch must be closed to insure energization of the start winding. If the switch is not fully closed, the motor may draw excessive current with a resulting damage to the motor windings. The switch unit is therefore designed to establish a relative large closing force to insure closure of the switch.

The spring member may be specially shaped to produce the desired spring action. In the design, the spring force is preferably selected to permit a high closing pressure without excessive loading of the actuator by the spring member. Excessive loading of the actuator may accelerate wear of the actuator and create erratic actuator functioning. Further, the actuator should move from the spring member with a relative large travel and so rapidly so as to release fully the spring member after which it can rapidly move to the switch open position.

The contact faces may be contaminated with foreign matter which interferes with the closing of the contacts. In addition to providing large closing pressures, various designs have been made to create relative lateral movement between the contact faces so as to remove any foreign matter from the contact faces. For example, U.S. Pat. No. 3,433,908, which issued Mar. 18, 1969 discloses a switch assembly having a movable contact secured to a specially shaped and bent leaf spring which moves with a twisting motion between the open and closed contact positions. The twisting motion creates an action for assisting in the separations of the contacts. Various other designs have provided movement in at least two perpendicular directions to provide improved separating forces as well as a cleaning action during the closing and opening movement of the contacts.

During the opening of the contacts, excessive arcing between the contacts may be created, particularly if the movable contact does not move with sufficient rapidity. Such arcing will tend to erode the contacts and may even create an actual welding of the contacts to each other. Erosion of the contacts will interfere with proper switching action. Welding of the contacts will prevent de-energization of the start winding and probable destruction of the motor. Both contact erosion and possible contact welding can be minimized if not absolutely prevented by proper design of the spring to produce the necessary opening force, as well as movement of the contacts relative to each other to separate contacts that may otherwise become welded.

Thus, in order to ensure a firm contact closure as well as a clean and rapid contact opening, various mechanisms or constructions have been provided for preloading of the contacts and providing for multiple motions of the contact surfaces relative to each other to produce a wiping action between the contact surfaces. The movement of the contacts relative to each other tend to affect a cleaning operation and a break-down of any build-up of material on the contact surfaces, thereby contributing to a more effective switch closure. For example, the previously noted U.S. Pat. No. 3,433,908 discloses a rather complex switch leaf spring unit having an offset spring arm with a deformed spring connection to preload the contact arm and such that the movement of the centrifugal actuator establishes a twisting movement of the contact arm as it moves between the closed and opened position. This is provided to create a corresponding twisting and wiping action between the contacts. Other mechanisms have been employed to impart mutually perpendicular motions to switch contact arm and therefore the contact during the opening and closing movement to effect a desired cleaning action. Generally, such mechanisms involve spring members which are deformed or bent in relatively complex manner mechanical components and spring members. The spring members of the prior art generally require careful and relatively expensive manufacture to adequately and fully establish proper and repeatable switch action. The demands on production techniques are particularly troublesome where mass production of a given design is desired in order to minimize the cost.

However, with a high opening spring pressure, the contact arm tends to bounce or vibrate upon opening. Vibration of the contact arm may result in a corresponding momentary reclosing and opening of the contacts, with possible arcing during opening of the contacts. The vibration of the contact arm may therefore create erratic energization of the start winding, and particularly where the switch assembly is cycled on and off a great number of times during the normal operating life.

Generally, the design of the contact spring member is a compromise of the various spring requirements including sufficient spring pressure and movement to producing an acceptable closure while also preventing erratic movement of the spring mounted contact.

The current design of induction motor also includes a demand for a reduction in the overall size of the switch unit to complement the reduction in the available end space or cavity in which to mount a centrifugal switch assembly. Although the switch mechanism can be physically located adjacent the windings, the magnetic field effect of the winding created by the motor winding may tend to interfere with the optimum switch operation. Thus, the magnetic field associated with the winding may extend the arc within the switch unit, resulting in further damage to the switch unit. Further, the switch unit must of course be connected to the windings and to the power supply. A substantial number of circuit connections is required to the winding on one side and to the incoming power supply to the other side of the mounting.

Further, in many applications the motor is stopped and started many times in any given day or other period. The several components of the centrifugal actuator and the associated switch assembly are therefore subjected to substantial mechanical wear.

As the result of the severe and continuing demands on the design of centrifugal switches, a need for a simple, reliable switch apparatus which can be mounted within a limited cavity, such as the end of an induction motor while maintaining a long-life with reliable switching operation under heavy cycling.

SUMMARY OF THE INVENTION

This invention is directed to a switch apparatus for rotary apparatus and particularly a dynamoelectric machine having an improved mounting and support to provide stable, repeatable operation of the switch. In accordance with one aspect of the present invention, the switch apparatus includes a generally flat multiple arm spring member having a plurality of spring arms including a pair of laterally spaced deflection arms projecting outwardly from a mounting portion to an outer bearing end and a pair of laterally spaced coupling arms connected to said bearing ends and projecting backwardly toward the mounting portion. The spring member includes at least one contact arm connected to a coupling arm and extending outwardly of the mounting portion. A fixed contact support is secured to the base member and supports a relatively fixed contact element in aligned, opposed relation to a contact element on the contact arm. The spring member is mounted to a base plate which is constructed to permit free movement of the coupling and contact arms through the base plate. A wear pad is secured to the outer bearing end of the deflection arms and engages the base member to deflect the deflection arms and deflect the coupling and contact arms. A centrifugal actuator is coupled to the machine and to the wear pad to move and position the wear pad and therefore the spring member to open and close the switch.

In a particularly and preferred unique construction, the wear pad includes a pair of laterally spaced coupling finger portions located to the opposite sides of the contact arm and adapted to ride on an actuator hub member slidably mounted on the machine shaft. The rotation of hub imparts a rocking motion on the wear pad with a resulting rocking motion of the spring member. The contact element on the spring member thus rocks on the opposed fixed contact element to establish firm and positive contact engagement. To stabilize the movement of the contact arm, a preload finger tab projects from the contact arm into engagement with the wear pad. The interengagement of the tab and pad minimizes contact vibration or bounce as the switch moves to the open position to insure a positive open and closed positioning of the contacts.

In still another unique aspect of the invention, the fixed contact support includes projecting side wall members defining an encircling shielding chamber about the opposed contacts. The shielding chamber serves to by-pass any magnetic field of the stator winding from the contact elements and confines the arc to the contact element. This provides a particularly effective confinement where the switch unit is mounted closely adjacent the stator winding and thus in close proximity to the magnetic field from the field winding.

The switch apparatus in an optimum structural arrangement including a base plate having the fixed contact support and the contact spring as well as the wear pad and circuit connection means disposed and mounted to the same side of the base plate. The base plate is mounted to the machine stator frame closely adjacent the field winding to minimize the required frame length.

More particularly, in a preferred and particularly practical construction, a flat base plate includes a mounting means for attachment to the motor stator frame located in a plane normal to the motor axis. A contact spring member is a flat spring member of a substantially rectangular configuration including a mounting portion along one minor edge which is affixed to the base plate. The spring member includes deflection arms along the major edges extending from the mounting portion to outer operator ends. Coupling spring arms are connected to the deflection arm immediately inwardly of the operator ends and extending backwardly toward the mounting portion. The coupling arms terminate in spaced relation to the mounting portion in a common connection portion. A contact arm extends outwardly from such common connection portion between the coupling arms. A wear pad is secured to the operator ends and is interposed between the deflection arms and the base plate to deflect the spring member relative to the base plate, which includes suitable apertures to allow the deflection of the coupling arms and the contact arm. A fixed contact support is a U-shaped member affixed to the outer side of the base plate and includes a contact element aligned with the outer end of the contact arm, which is provided with an opposed contact element. The contact elements are held in spaced relation with the wear pad engaging the base plate, and moving into engagement by moving of the wear pad outwardly. The fixed contact support is formed of magnetically conductive metal and is formed with plurality of side walls extending outwardly about the contact button to enclose both the fixed contact and the movable contact and end of the contact arm.

Terminal elements are secured to the mounting portion of the spring member and the fixed contact support to the same side of the base plate.

The wear pad bridges the spring member between the operator portions and includes outwardly projecting wear coupling fingers. An hub actuator is mounted to the motor and rotates therewith, with a centrifugal operator establishing axial movement on the shaft. The hub has a flat outer face which moves into engagement with the coupling fingers. As the actuator moves on the shaft, the opposite sides of the actuator moves with the flat face offset to cause the wear pad to move with a superimposed rocking motion, causing the contact button to pivot or rock on the fixed contact button to minimize contact welding.

The contact arm includes a stabilizing finger or tab which projects outwardly into the path of the wear pad and is engaged thereby as the pad moves into engagement with the wear pad. The stabilizing tab serves to minimize contact vibration or bounce upon opening of the contacts.

DESCRIPTION OF THE DRAWING FIGURES

The drawings furnished herewith illustrate a preferred construction of the present invention in which the above advantages and features are clearly disclosed as well as others which will be readily understood from the following description.

In the drawings:

FIG. 3 is an exploded view of the start switch apparatus shown in FIGS. 1 and 2;

FIG. 4 is an enlarged sectional view of the switch unit shown in FIGS. 1 and 2;

FIG. 5 is an enlarged sectional view illustrating the movement of the contacts of the switch assembly during opening and closing.

DESCRIPTION OF THE ILLUSTRATED EMBODIMENT

Figure 1:
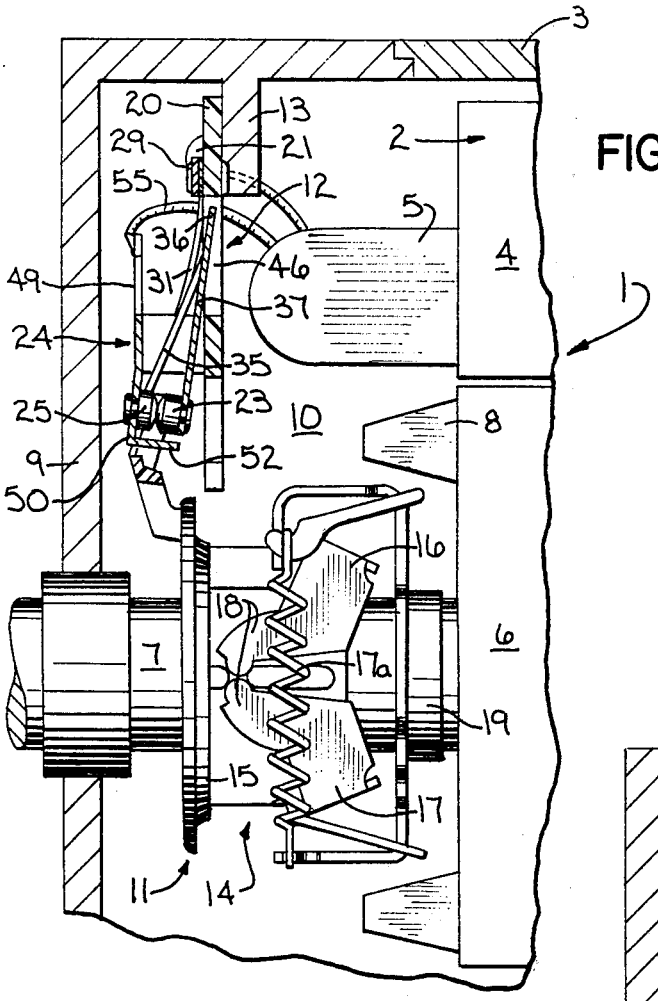
FIG. 1 is a fragmentary view of one end of a single phase induction motor having a centrifugally switch mounted therein.
Figure 2:
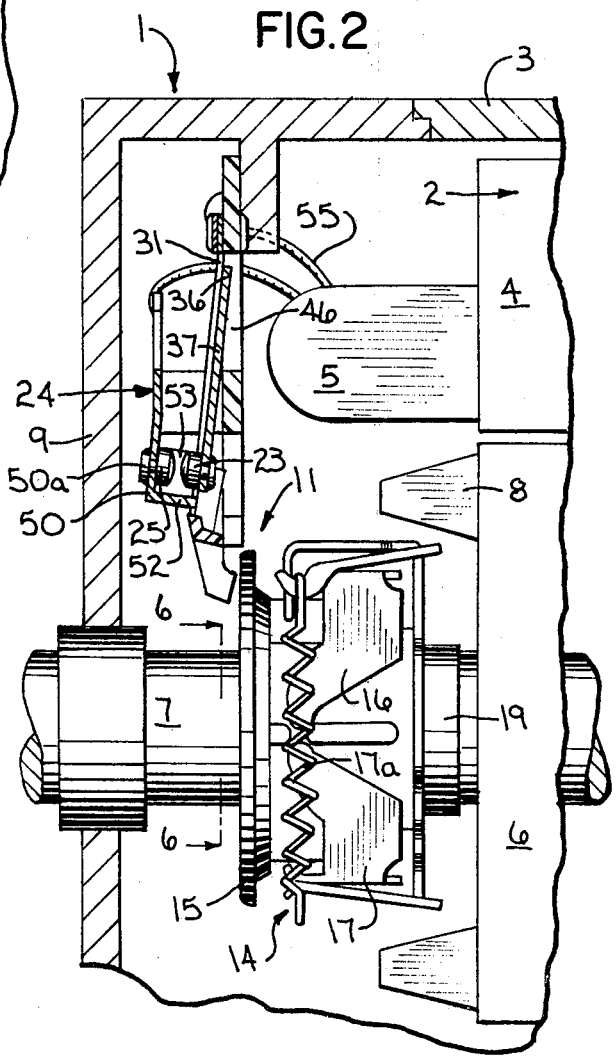
FIG. 2 is a view similar to FIG. 1 showing an alternate switch position.

Referring to the drawings and particularly to FIG. 1, an induction motor 1 is illustrated including an annular stator 2 mounted within an outer tubular frame 3. The stator 2 includes a magnetic stator core 4 secured to the frame 3. A field winding 5 is wound in the stator core 4. The field winding 5 generally includes a run winding and an offset separate start winding which are interconnected to each other and to power supply as hereinafter described. Because such detail is well known, it is not specifically and separately shown herein. In accordance with conventional practice, a rotor 6 having a rotor shaft 7 is rotatably mounted within the stator 3. The illustrated rotor 6, as widely employed in an A.C. induction motor, includes a cast squirrel-cage winding 8 embedded within the rotor and thus located within the magnetic field of the field winding 5. The motor shaft 7 is supported within a cup-shaped end closure bell 9 secured in abutting relation to the outer end of the tubular motor frame 3. The end bell 9 defines an end chamber 10 within which a centrifugally actuated start switch assembly 11 is located. The start switch assembly 11 is electrically connected into circuit with the start winding of the field winding 5 for selected connection of the start winding into the circuit only during the starting of the motor and until such time as the rotor reaches or closely approaches normal operating speed. The start winding is primarily connected into the circuit during the initial starting period to increase the starting torque for accelerating of the motor to operating speed. The centrifugally actuated start switch assembly 11 includes a start switch unit or apparatus 12 which is mounted on a suitable bracket 13 within the end chamber 10 immediately adjacent to the axial end of field winding 5. A centrifugal actuator 14 is located on the motor shaft 7 and in particular includes a hub 15 which is slidably mounted on the shaft 7. A pair of oppositely located centrifugal weights 16 and 17 having similar pivot arms 18 which are pivotally secured to the hub 15 and spring loaded to a first position. The centrifugal weights 16 and 17 are attached to a securement hub 19 which is firmly affixed to the rotor shaft 7 and spring loaded by suitable coil springs 17*a* to an inner rest position, as shown in FIG. 1. The hub 19 is mounted to locate the face of the hub in engagement with the switch unit or apparatus 12 at rest (FIG. 1) and serves to hold the switch unit closed. Thus, the start winding is thereby connected into circuit during the initial starting period. At the desired or switching speed, the centrifugal weights 16–17 move outwardly, as shown in FIG. 2, with a snap action under the force of the rotational centrifugal forces and provide a corresponding retract movement of the hub 15 which snaps outwardly from the start-switch unit 12 to the position of FIG. 2. As a result, the start-switch unit 12 moves to an open circuit position, thereby disconnecting of the start winding from circuit. The details of the stator, rotor and the like, as well as the centrifugal operator may be of any known or other desired construction. No further description of the detail of such components is therefore given other than as necessary to fully describe the present invention which is particularly directed to a unique centrifugally actuated switch unit apparatus, a preferred embodiment of which is shown in the drawings and its mounting within the motor. The centrifugal actuator is preferably constructed as disclosed in the inventor's copending application entitled "Centrifugal Actuator for A.C. Induction Motor" which was filed on Apr. 28, 1981 and which is assigned to the same assignee as this application.

The illustrated switch unit 12 generally includes an insulating mounting plate 20 which is secured to the bracket 13 by appropriate mounting bolt members 21. A special contact spring member 22 is secured to the base plate and carries a movable contact element 23, shown as a well contact button 23. A fixed contact support 24 is secured to the base plate and supports a fixed contact element 25, also shown as a contact button. The fixed contact 25 is located in aligned and opposed relation to the movable contact button 23, and is selectively engaged by the contact button 23 by deflecting of the spring member 22.

The special contact spring member 22 includes a coupling pad 26 secured to the outer end of the contact spring member 22 and located in the path of the actuator hub 15 for selectively positioning of the spring member 22 and the interconnected contact button 23 with respect to the fixed contact 25. The contact spring member 22 is thereby moved axially of the motor axis to provide a corresponding movement of the contact button 23 with respect to the fixed contact 25 between an engaging closed switch position of FIG. 1 and a spaced opened switch position of FIG. 2.

More particularly, the unique switch assembly or unit 12 includes the contact spring member 22 which is specially formed in an optimum construction as a flat single piece spring member of a suitable contact spring material, such as metal. The spring member 22 is a generally rectangular plate-like member having a mounting strip 27 along a minor side or edge of the spring member. The mounting strip 27 is secured abutting the base plate 20 with a terminal strip 28 overlying the mounting strip. The assembly is riveted to the base plate as by pin rivets 29. A terminal tab 30 is bent upwardly and outwardly of the base plate 20 for receiving of a bayonet type connection. The contact spring member 22 includes a pair of deflection spring arms 31 and 32 extending outwardly from the terminal strip 28 and mounting strip 27 along the outermost sides portions of the spring member 22. The outermost ends of the deflection spring arms 31 and 32 are secured as by riveting to the coupling or wear pad 26.

A pair of connecting spring arms 33 and 34 are formed in the spring member located immediately inwardly and parallel to the deflection arms 31 and 32. The connecting spring arms 33 and 34 are connected to the adjacent deflection spring arms 31 and 32 by similar connecting portions 35 located inwardly of the riveted connection to the wear pad 26. The inner ends of the spring arms 33 and 34 are integrally joined to a common bridging portion or base 36, shown having a generally semi-circular configuration. A contact spring arm 37 is formed in the spring member between the connecting spring arms 33 and 34 and extends outwardly from the base 36 centrally between the spring arms 33 and 34. The contact arm 37 extends outwardly and terminates between the outermost end of the deflection spring arms 31 and 32, with the outermost end spaced slightly inwardly of the wear pad 26. The contact button 23 is secured to the outermost end of the contact arm 37 by a suitable button rivot 38.

The spring member 22 is a single piece member with the several spring portions and members stamped or cut from the spring plate to define the several spring arms.

A stabilizing tab 39 extends outwardly from one side of the outer end of the contact arm 37 adjacent the contact button 23. The tab 39 is of a sufficient length to locate the outermost end in overlapping engagement with the wear pad 26 as at 40. The overlap 40 of the stabilizing tab 39 and the wear pad 26 dampens the contact arm movement, as more fully developed hereinafter.

The illustrated wear pad 26 is a bridging member formed of a suitable low friction material. The illustrated bridging member is generally an H-shaped plastic member formed of Teflon or other suitable low-friction and wear resistant plastic material. The member includes a pair of mounting or coupling fingers 41 which are riveted to the corresponding ends of the deflection spring members 31 and 32. A bridging stem portion 42 is thus located immediately outwardly of the riveted connections and spans the spring member 22 immediately outwardly of the contact spring contact arm 37 and the contact 23. The opposite side of the H-shaped member defines a pair of wear fingers or portions 43 which project outwardly from the stem portion 42 and therefore from the spring member. The stem 42 and the projecting coupling fingers 43 are generally offset from the plane of the connecting or coupling fingers 41. Further, the bridging portion or stem 42 is aligned with the outermost edge of the adjacent mounting plate, with the coupling fingers 43 projecting outwardly of the insulating base plate. The offset portion of the pad in the standby or rest position rests on the base mounting plate as at 44 and serves to deflect the deflection spring arms 31–32 outwardly as at 45. The outward deflection of the deflection arms 31–32 tend to move the connecting arms 33–34 and base portion 35 inwardly slightly. The base plate 20 is provided with an opening 46 having a generally semi-circular opening generally conforming to the inner end of the spring base portion 36 to allow the free or essentially unrestricted movement of coupling arms 33 and 34, and the contact arm 37 as well as the interconnecting base portion 36. The deflection movement also moves the stabilizing tab 39 into engagement with the bridging stem portion 42 of the wear pad 26. In the illustrated embodiment, the deflection of the spring member 22 by the engagement of pad 26 with the mounting plate 20 positively holds the contact arm 37 and the interconnected contact 23 in a selected spacement to the fixed contact button 25, as shown in FIGS. 2 and 4 to establish a normally open switch position. The arrangement requires the location of the actuator 14 to deflect spring arms 31 and 32 to move the contacts to the closed position. As the motor accelerates, the rotor 6 and interconnected motor shaft 7 accelerates the centrifugal actuator 14. At a selected speed, the weights 16–17 snap out and the hub 15 retracts and moves away from the wear pad 26. The pad 26 snaps to the standby position, engaging the base plate 20, and opens the switched contacts 23–25.

The fixed contact is carried by the contact support 24. In the illustrated embodiment of the invention, the fixed contact support 24 is generally a U-shaped member having mounting foot portions 47 which are riveted to the base plate 20 overlying the contact spring member 22. The U-shaped member includes an outwardly located bridging portion 48 with a plurality of terminal tabs 49 located to the outer back side of the bridging portion 48 and to the one foot portion. The terminal tabs 49 provide for bayonet-type connections to the fixed contacts 25. The contact support 24 includes a support arm 50 extending outwardly from the bridging portion 48 in alignment with the outer end of the contact spring arm 37. The fixed contact 25 is correspondingly riveted or otherwise secured to the arm 50 as at **50*a* to support the fixed contact 25 in opposed, aligned relation to the movable contact 23 on the outer end of the movable contact spring arm 37. The contact support 24 and particularly the contact arm 50 includes inwardly extending side walls 51, 52 and 53 located outwardly of and to either side of the fixed contact. The walls 51–53 extend outwardly a sufficient distance to enclose the fixed contact 25 and the movable contact 23 in the closed contact position of FIG. 1. The walls 51 and 52 are notched or shortened (as at 54) in the location of the stabilizing tab 39 to define an offset which accommodates the extension of tab 39 outwardly beyond the fixed contact and into engagement with the wear pad 26, as previously described. The terminal arm 50 and depending walls 51–53 thus define four sides of a six-sided cube enclosing the contacts 23–25. The support 24 is formed of a suitable metal, such as steel adapted to carry magnetic flux. The walls 50–53 thus define a magnetic shield or bypass means around the contacts for eliminating flux through the contacts 23–25. The partial protective enclosure of the contacts permit location adjacent the winding 5 without extension and prolongation of an arc which may be formed between the contacts. This permits closer spacement of the switch assembly adjacent the winding 5**.

The enclosure of the contacts is shown including a back and three sides. Obviously a fourth side could be provided by a suitable wall extending from arm 50 between walls 51 and 53. Further, an extended wall could even be bent over or below the contacts to provide an essentially completely six sided cubic enclosure. In any event at least two sides should be provided to provide a continuous path about the contacts.

As noted most clearly in FIGS. 1 and 2, the base plate 20 is secured to the bracket 13 which is located closely adjacent to the field winding 5. The base plate is mounted with the switch spring components of the switch assembly all mounted to the one side of the base plate 20 and particularly is located with the component facing away from the winding 5. This mounting locates the insulating face of the switch assembly to the winding and thereby permits relatively mounting with a minimum distance from the field winding 5. The close-spaced mounted also minimizes the length of the field leads 55 and permits a more compact and convenient mounting, with minimize possible interference between the leads, the switch assembly and the centrifugal actuator.

In operation, the switch assembly 11 and actuator 14 have an initial closed standby or start position shown in FIG. 1. The power supply to the motor winding in complete and the motor accelerates with both the run winding and the start winding energized as a result of the closed centrifugal switch unit 12. At a predetermined switching speed, the centrifugal force acting on the weight members 16–17 of the centrifugal actuator 14 reaches the level which overcomes the loading of the actuator springs 17*a*. The weight members 16–17 at that time move with a snap action movement to a retracted position as shown in FIG. 2. The operating member 15 rapidly moves to the spaced run position with the operating disc in spaced relation to the switch spring and particularly wear pad 26 of the switch unit 12. The spring force of the deflection spring means 31–32 of the spring member 22 causes the wear pad 26 to move into engagement with the base plate 20, resulting in a limited movement of the interconnected contact arm 37 and the associated contact 23 to the open circuit position of FIG. 2. This of course results in de-energization of the start winding circuit and the motor 1 continues to run with power supplied only to the run winding portion of field winding 5. The deflection of the spring arms create a relatively large force which assists in the breaking and separation of the contacts and producing a rapid opening so as to minimize arcing between the contacts. As shown most clearly in FIGS. 3 and 5, the actuator disc engages the pad 26 with a two point engagement defined by the outwardly projecting arms 43 of the wear pad 26. This creates a low friction engagement between the members and minimizes the loading of the actuator.

Figure 6:
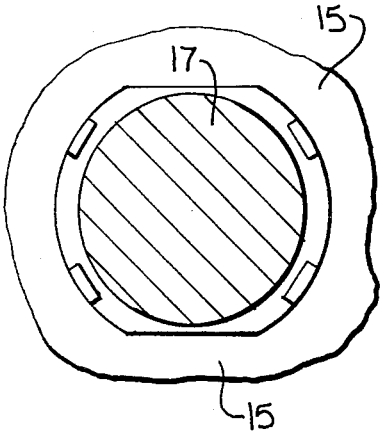
FIG. 6 is a vertical fragmentary section taken generally on line 6—6 of FIG. 2.

The actuator hub 15 is designed to have a certain limited amount of run-out, as shown in FIG. 6, as the hub moves between the switch closed and switch opened position. The wear pad arms 26 independently follow the run out of the aligned and engaged portion of the hub member. The wear pad arms 26 independently follow the run out of the aligned and engaged portion of the hub member. The wear pad surfaces or arms will thus be moving in opposite directions at any given moment and thus rock back and forth between the full and dash lined positions of the disc, as most clearly shown in FIG. 5. As a result, the contact spring member 22, including the contact arm 37 and interconnected movable contact 23, has a corresponding back and forth rocking motion. The face of the movable contact 23 therefore rocks over the face of the fixed contact 25 as the contact 23 is moved between the open and closed positions. This action contributes to a reliable operation and long life of the contacts. During the movement of the switch unit to the open position, when arcing can occur and cause contact erosion or even welding of the contacts, the rocking motion moves the position of arc over the contact surfaces so as to minimize erosion and essentially totally prevent welding of the contacts.

The interengagement of the wear pad 26 with the base plate 20 sets the spring deflection and tension while producing a relatively low force interengagement with the centrifugal actuator.

As previously noted, the stabilizing tab 39 and its engagement with pad 26 functions to dampen the movement of the spring arm 37 and prevent undesirable contact bounce and vibration in the presence of rapid contact opening action. The movement of the contacts is quite short, such that any vibration or bounce of the contact arm 37 and the interconnected contact 23 would tend to restrike the arc between the contacts. An erratic energization of the start winding would interfere with the desired starting sequence and may well damage the motor.

The stabilizing tab 39 of the present embodiment, however, through its interengagement with the wear pad 26 establishes a sufficient preload on the deflected contact spring arm 37 so as to prevent vibratory motion thereof during the rapid opening of the switch.

The deflection of the contact spring 22 by the wear pad 26 permits accurate setting of the spring force and the contact location. This significantly minimizes and essentially prevents vibratory motion of the spring in the run position by maintaining the spring under a loaded state. This interaction of the spring member and wear pad with the plate or other suitable portion of the switch assembly provides a simple and accurate means of setting the spring configuration because it does not rely on the use of any special forming of the spring member and particularly provision of especially formed angles. The deflection and resulting spring force is essentially totally dependent on the spacing of the wear pad with respect to the base plate. The spring member can be readily formed by suitable stamping of a given flat spring metal member. This requires a simple manufacturing process which establishes and holds close tolerances without the necessity of additional stops or the like. The forming of the spring thus avoids the sensitivity to the design and manufacturing tolerances necessary in deforming the metal spring.

The present invention thus provides a significant improvement in a switch unit for rotary equipment in which a rapid acting speed-responsive switching is required. The switch unit is constructed of relatively minimal number of components, all of which can be readily constructed in accordance with acceptable and known manufacturing techniques. The switch assembly provides a very stable state in both the closed and opened positions as well as moving positively between positions. The switch unit of this invention thus provides an improved switch unit at a lesser cost while maintaining a more optimum, improved performance.

Various modes in carrying out the invention are contemplated as being within the scope of the following claims, particularly pointing out and distinctly claiming the subject matter which is regarded as the invention.

I claim:

1. A switch apparatus for a dynamoelectric machine having a speed responsive actuator moving from a first position to a second position in response at a preselected speed, comprising:

a support base;

a flat multiple arm spring unit having a plurality of laterally spaced spring arms including a pair of deflection spring arms attached to the support base and projecting from the attachment and a pair of connecting arms secured to the outer ends of the deflection arms and extending backwardly therefrom between said deflection arms and at least one contact arm secured to the inner end of both said connecting arms and extending backwardly therefrom to an outer end;

a first contact secured to the outer end of said contact arm;

a second contact mounted in opposed aligned relation to said first contact; and coupling means secured to said deflection arms for moving said arms and thereby moving said connecting arms and contact arm to move the first contact relative to the second contact.

2. The switch apparatus of claim 1 wherein said coupling means includes a contact pad secured to the outer ends of the deflection arms outwardly of the connecting arms for moving said interconnected spring arms and locating said spring arms relative to said support base.

3. The switch apparatus of claim 2 wherein said contact pad includes a portion located between the spring unit and the support base to deflect said deflection arms with the contact pad abutting the support base.

4. The switch apparatus of claim 2 wherein said spring unit includes a single piece spring metal plate having said spring arms formed therein, and having said deflection arms located to the opposite sides of said plate and connected at one end by an end portion of the metal plate and having said connecting arms and contact arm located between said deflection arms.

5. The switch apparatus of claim 4 wherein said deflection arms extend outwardly of the connecting arms and contact arm, and said contact pad is a plastic bridging member secured to said deflection arms outwardly of the connecting and contact arms, said contact pad including an inner portion aligned with and abutting the base to deflect the deflection arms and thereby deflect the contact arm from the plane of the spring unit.

6. The switch apparatus of claim 5 wherein a stabilizing tab member is secured to said contact arm and engages said contact pad to preload said contact arm and thereby to minimize vibration and bounce of the contact arm.

7. The switch apparatus of claim 1 having a fixed contact support having a generally channel-shape with opposite side legs secured to said base to the opposite sides of said spring unit and having a contact tab aligned with the outer end of the contact arm, an opposed contact secured to the outer end of the contact tab in alignment with the contact secured to said contact arm, said contact tab having a plurality of inwardly projecting side walls defining a magnetic shield about said contact elements for shielding said contacts from the magnetic field of said motor.

8. A stationary start switch for an induction motor comprising:

a mounting base plate of an insulating material;

a flat planar spring member formed of a single flat spring metal member having a generally rectangular configuration and including a base mounting means on a minor width portion of the member;

a pair of spring deflection arms extending outwardly from said base mounting means and terminating in outer operator end portions;

a pair of coupling arms located between said deflection arms and extending one each from said deflection arms adjacent said end portions backwardly toward said mounting means and terminating in a common laterally extending connecting portion; and a contact arm extending outwardly from said common laterally extending connecting portion;

means mounting said mounting means to a first side of said base plate, with opening means to allow unrestricted free movement of said coupling arms and contact arm;

a bridging contact pad secured to the operator end portions and engaging said first side of said base plate to deflect said deflection arms from the plane of the spring member;

a fixed contact support having a generally channel shape with opposite side legs secured to said base plate to the opposite sides of said spring member and having a contact tab aligned with the outer end of the contact arm;

opposed contact elements secured to the outer end of the contact tab and contact arm, said contact elements being spaced from each other with said contact pad engaging said base plate and said contact arm moving outwardly in response to movement of the contact pad to engage said contact elements; and said tab having a plurality of inwardly projecting side walls defining a magnetic shield about said contact elements for shielding said contacts from the magnetic field of said motor.

9. The start switch of claim 8 wherein a stabilizing tab member is secured to said contact spring arm and engages said pad to preload said spring arm and minimize vibration and bounce thereof.

10. The start switch of claim 8 wherein said bridging includes laterally spaced coupling wear fingers adapted to engage a centrifugal actuator hub movable on a motor shaft for imparting a rocking motion to said spring member and thereby rock said one contact element on the opposed contact element.

11. A start switch apparatus for rotary dynamoelectric apparatus, comprising a mounting plate, a contact member secured to said plate and having a leaf spring contact arm supporting a movable contact on the outer end, a fixed contact support member formed of a magnetically conductive material secured to said plate in overlying relationship to said outer end of said contact arm and having a contact located in aligned opposed position relative to said movable contact, said support member including a plurality of projecting wall members closely spaced about the sides of the fixed contact for conducting of a magnetic field around said fixed contact and thereby removing said magnetic field from the gap between said fixed contact and said movable contact.

12. A switch apparatus for rotary equipment incluidng a base support member, a leaf spring contact member secured to said support member and having a movable outer end, a first contact secured to said contact spring member and a second contact mounted in opposed alignment with said first contact, a spacer member secured to said spring member and interposed between the spring member and the support member and establishing a first contact portion with a selected spring deflection to preload the spring member in said first contact position, coupling member secured to said spring member and located for engagement with an operator for moving and holding said spring member from said support member with an increasing deflection of the spring member to a second contact position with said spacer member and said support member disengaged and wherein said leaf spring member is a flat plate of a spring metal, said spring member including a plurality of interconnected spring arms including a contact arm located between a pair of deflection arms, said deflection arms being fixedly mounted at one end and secured to said coupling member at the opposite end.

13. The switch apparatus of claim 12 wherein said deflection arms and contact arm are parallel elongated strip-like portions, said spring member including a pair of flexible connecting arms located one each between the deflection arms and the contact arm and connected to the outer end of the deflection arms and the inner end of the contact arm.

* * * * *

UNITED STATES PATENT AND TRADEMARK OFFICE

CERTIFICATE OF CORRECTION

PATENT NO. : 4,419,550

DATED : December 6, 1983

INVENTOR(S) : Gerald J. Monette

It is certified that error appears in the above-identified patent and that said Letters Patent are hereby corrected as shown below:

Abstract, line 9, cancel "abutts" and substitute therefore ---abuts---; Col. 11, line 13, after "deflection" insert ---spring---; Col. 11, line 21, after "deflection" insert ---spring---; Col. 11, line 27, after "deflection" insert ---spring---; Col. 11, line 33, after "deflection" insert ---spring---; Col. 11, line 38, after "deflection" insert ---spring---; Col. 11, line 43, after "deflection" insert ---spring---; Col. 11 line 45, after "deflection" insert ---spring---;

Col. 11, line 59, cancel "an" and substitute therefore ---said---; cancel "opposed"; Col. 11, line 60, after "contact" insert ---being---; Col.11, line 61, after "said" insert ---first---; Col. 12, line 41, cancel "spring"; Col. 12, line 42, cancel "spring" and insert ---contact---; Col. 12, line 44, after "bridging" insert ---pad---

UNITED STATES PATENT AND TRADEMARK OFFICE

CERTIFICATE OF CORRECTION

PATENT NO. : 4,419,550

DATED : December 6, 1983

INVENTOR(S) : Gerald J. Monette

It is certified that error appears in the above-identified patent and that said Letters Patent are hereby corrected as shown below:

Col. 12, line 66, delete "cluidng" and substitute therefore ---cluding---

Signed and Sealed this

*Fifteenth* Day of *January 1985*

[SEAL]

*Attest:*

*Attesting Officer*

GERALD J. MOSSINGHOFF

*Commissioner of Patents and Trademarks*